United States Patent [19]

Popescu

[11] 4,222,829

[45] Sep. 16, 1980

[54] ALKALINE ZINC ELECTROPLATING BATH AND PROCESS

[76] Inventor: Francine Popescu, 27, Rue du Centre, 94490 Ormesson, France

[21] Appl. No.: 64,504

[22] Filed: Aug. 7, 1979

[30] Foreign Application Priority Data

Aug. 8, 1978 [FR] France ..... 78 23312

[51] Int. Cl.[2] ..... C25D 3/22

[52] U.S. Cl. ..... 204/55 R

[58] Field of Search ..... 204/55 R, 55 Y, 114, 204/43 Z

[56] References Cited

U.S. PATENT DOCUMENTS

| | | | |
|---|---|---|---|
| 3,393,135 | 7/1968 | Rosenberg | 204/55 Y |
| 4,022,676 | 5/1977 | Popescu | 204/55 R |
| 4,135,992 | 1/1979 | Fikentscher et al. | 204/55 R |
| 4,146,442 | 3/1979 | McFarland | 204/55 Y |

FOREIGN PATENT DOCUMENTS

| | | | |
|---|---|---|---|
| 461074 | 11/1949 | Canada | 204/55 Y |

*Primary Examiner*—G. L. Kaplan

*Attorney, Agent, or Firm*—Gifford, VanOphem, Sheridan & Sprinkle

[57] ABSTRACT

Bright zinc electrodeposition is accomplished in a non-cyanide alkaline bath using a water soluble, nitrogen-containing polymer having recurrent units of

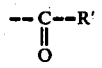

liberally substituted. The polymers of the invention are generally formed by the acylation of polyalkylamines and similar polymers with acid chlorides of various organic acids.

16 Claims, No Drawings

ALKALINE ZINC ELECTROPLATING BATH AND PROCESS

BACKGROUND OF THE INVENTION

This invention relates to the electrodeposition of bright zinc from an alkaline, aqueous zinc electroplating bath and to brighteners to be used in such baths.

SUMMARY OF THE PRESENT INVENTION

According to the present invention, it has been found that bright, ductile and uniform zinc deposits may be obtained on metallic cathodes from an alkaline, noncyanide, zinc electroplating bath containing an effective amount of a brightener dissolved therein and consisting mainly of a water soluble, nitrogen-containing polymer, compatible with said bath, said polymer comprising recurrent units of an alkylene amine in which one or several nitrogen atoms are acylated by a group:

$$-\underset{\underset{O}{\|}}{C}-R'$$

wherein R' represents an alkyl, alkenyl, phenyl, alkylphenyl, naphthyl, pyridyl, furyl or thienyl radical, which radical may be unsubstituted or substituted with one or several substituents selected from: hydroxy, alkyl, carboxy, sulfoxy or halogen.

Typical polymers, in accordance with this invention, are the polyalkyleneimines reacted with an acylating agent such as the acid chlorides of saturated aliphatic acids, the acid chlorides of aromatic acids, the anhydrides of aliphatic and aromatic acids, etc.

Other suitable polymers are the polymers obtained by the reaction of an alkylene polyamine with an epihalohydrin or a dihalohydrin and further reacted with an acylating agent.

More particularly, the starting polymers, used according to this invention, are the polyethyleneimines of molecular weight comprised between 150 and 60,000 and which are reacted with an acylating agent.

Such acylated polyethyleneimines may be represented by the formula:

$$H_2N-(CH_2-CH_2-\underset{\underset{R'}{|}}{\overset{}{N}}{\underset{C=O}{|}})_m-(CH_2-CH_2-\underset{\underset{R''}{|}}{N})_n-H \qquad (I)$$

wherein R' has the signification described above; R'' is a hydrogen atom or an alkyl radical which may be unsubstituted or substituted by one or several substituents selected from: hydroxy, carboxy, sulfoxy, carboxyester, amino (primary, secondary or tertiary amino group) or halogen; m is from 1 to 1,000, preferably from 1 to 100; n is from 1 to 999, preferably from 1 to 99 and m+n is from 2 to 1,000 preferably from 2 to 100 (m,n and m+n are average values determined by the nature of the starting polymer and then m,n, and m+n may have fractional values, within the specified limits).

The substituted or nonsubstituted alkyl radical, represented by R'' in the formula (I), may be introduced in the molecule of the polymer either before the acylation reaction, or after this reaction, by utilizing the known techniques of aklylation or sulfoalkylation at the nitrogen atoms.

The reaction for obtaining the polymers responding to formula (I) is an acylation to nitrogen and it consists of attaching a group $$-\underset{\underset{O}{\|}}{C}-R'$$

to the primary or secondary nitrogen atoms belonging to the starting polymer.

All the primary or secondary nitrogen atoms of the starting polymer molecule may be acylated, but it is preferred to utilize an acylation rate of 10 to 60%, in order to obtain the best results of this invention. This reaction is accomplished according to the known methods of acylation at the nitrogen atom (preparation of carboxamides), in aqueous or organic solvent medium and using acylating agents known in the technique.

DESCRIPTION OF THE PREFERRED EMBODIMENT

A great variety of acylation agents may be utilized, namely the saturated and nonsaturated aliphatic acids, the aromatic and aralkylic acids. Instead of the free acids, one may utilize other derivatives, such as the acid chlorides, the acid anhydrides, the esters and their hydroxylated, halogenated or sulfoxylated substitution derivates.

Here are some nonlimiting examples of acylating agents amenable to the application of this invention;

Saturated aliphatic acids: acetic, propionic, butyric, pelargonic, caprylic, undecylenic, lauric, glycolic, lactic, succinic, sulfopropionic, oxalic and similar acids.

Nonsaturated aliphatic acids: acrylic, methacrylic, crotonic, angelic, tiglic, pentenoic, maleic, propiolic, fumaric, itaconic and similar acids.

Aromatic acids: benzoic, hydroxybenzoic, toluic, alkoxybenzoic, homophthalic, phenylacetic, mandelic, naphthoic, nicotinic, furoic, thenoic and similar acids.

Acid chlorides: acetyl chloride, propionyl chloride, butyroyl chloride, veloroyl chloride, pelargonyl chloride, lauroyl chloride, ethyl-hexylic acid chloride, benzoyl chloride, phenylacetyl chloride and other similar chlorides.

Acid anhydrides: acetic anhydride, propionic anhydride, butyric anhydride, valeric anhydride, hexanoic anhydride, benzoic anhydride, phthalic anhydride, succinic anhydride, 1, 8-naphthalic anhydride, chloro-4-1, 8-naphthalic anhydride and other similar anhydrides.

The following nitrogen-containing polymers are preferred, according to this invention, to be reacted with an acylating agent:

(a) a polyethyleneimine of molecular weight comprised between 150 and 60,000 or one of its salts with an organic or mineral acid compatible with the zinc plating bath (e.g., salts of hydrochloric, formic, acetic acids, etc.).

(b) a polyethyleneimine partially substituted by one or several alkyl groups, i.e., a polyethyleneimine wherein one or several hydrogen atoms, belonging to the ethylene units, are replaced by alkyl groups, which alkyl groups may be nonsubstituted or substituted by one or several identical or different groups selected from: hydroxy, carboxy, carboxyester, amino or by halogen; the molecular weight of these substituted polyethyleneimines is preferably comprised between 200 and 60,000.

(c) a polyethyleneminie partially alkylated or sulfoalkylated at the nitrogen atoms, i.e., a polyethyleneimine wherein one or several nitrogen atoms of its molecule (preferably 5 to 30% of the total number of nitrogen atoms belonging to the polymer chain) are bonded to an alkyl group, which alkyl group may be nonsubstituted or substituted by one or several identical or different groups selected from hydroxy, carboxy, carboxyester, sulfoxy ($SO_3^-$) or amino (primary, secondary, tertiary or quaternary amino groups); such polymers are described, for instance, in the U.S. Pat. No. 4,022,676. The molecular weight of the polyethyleneimines alkylated at nitrogen is comprised between 200 and 60,000.

(d) the cationic polymers obtained by the reaction of ammonia, aliphatic amines or of alkylenepolyamines with an epihalohydrin or dihalohydrin. Such polymers are described in the U.S. Pat. No. 3,248,353 and in the French Pat. Nos. 1,426,760 and 771,836.

One may advantageously utilize, as starting polymers, according to this invention, the polymers obtained by the reaction of epichlorohydrin with an alkylenepolyamine selected from: dimethylaminopropylamine, diethylaminopropylamine, diethylenetriamine, tetraethylene-pentamine. The molecular weight of these polymers is comprised between 200 and 10,000. An example is the polymer obtained by the equimolar reaction of tetraethylenepentamine with epichlorohydrin, in aqueous medium and at 40–60° C. temperature.

A preferred method, according to this invention, to obtain polymers particularly valuable as alkaline zinc electroplating brighteners, is to do a partial acylation on a polyethyleneimine of molecular weight comprised between 200 and 5,000 and to further submit the resulted partially acylated polymer to an alkylation or sulfoalkylation reaction, by reacting it with an alkylating agent such as methyl chloride, ethyl chloride, dimethylsulfate, diethylsulfate, ethylenechlorohydrin, chloroethanesulfonic acid or 3-chloro-2-hydroxypropanesulfonic acid, following the techniques described in U.S. Pat. No. 4,022,676.

The acylation rate of such a polymer is selected between 5 and 30%, calculated on the number of its primary and secondary nitrogen atoms, and the alkylation rate between 1 and 20%, calculated on the total number of the nitrogen atoms of the polymer.

The recurrent units of such an acylated and sulfoalkylated polymer may be represented schematically by the formula:

$$-(CH_2-CH_2-\underset{\underset{R'}{|}}{\overset{|}{N}}{}_{C=O})-(CH_2-CH_2-\underset{\underset{R_1-SO_3Me}{|}}{N})-(CH_2-CH_2-NH)- \quad \text{(II)}$$

wherein R' has the signification described above and $R_1$ is a lower alkylene group (1 to 4 carbon atoms) or a lower hydroxyalkylene group and Me is hydrogen or an alkaline metal.

The following examples illustrate, in a nonlimiting manner, the preparation of the acylated, nitrogen-containing polymers object of this invention.

EXAMPLE 1

100 g. of a 50% aqueous solution of a polyethyleneimine of molecular weight 700 and 12.8 g. of a 50% solution of sodium hydroxide are introduced in a reaction vessel. 15 g. of propionyl chloride are added, drop by drop, under agitation and cooling, so that the temperature remains under 30° C. Then the mixture is heated during one hour under reflux. The resulting solution, which contains approximately 50% of acylated polyethyleneimine, is utilized as alkaline zinc electroplating brightener, according to this invention.

EXAMPLE 2

100 g. of a 50% aqueous solution of a polyethyleneimine of molecular weight 400 and 10 g. of butyric anhydride are introduced in a reaction vessel and the mixture is heated under reflux during 3 hours.

The resulting solution, which contains about 50% of acylated polymer, is utilized as alkaline zinc brightener, according to this invention.

EXAMPLE 3

In a reaction vessel, equipped with stirrer, thermometer and water separating device, are introduced 1 mole (900 g.) of polyethyleneimine of molecular weight 900, 900 g. of xylene and 157 g. (1 mole) of pelargonic acid. The reaction mixture is heated gradually to 150° C. and maintained at this temperature for about 3 hours, until 18 g. (1 mole) of water is collected in the separator. The xylene is then eliminated by vacuum distillation (20 mm). The final product is a brown viscous liquid which is dissolved in water to form a 50% solution utilizable as alkaline zinc electroplating brightener.

EXAMPLE 4

1,400 g. of a 50% aqueous solution of polyethyleneimine of molecular weight 700 and 29.6 g. phthalic anhydride are introduced in a reaction vessel and heated under reflux for 3 hours. 39.3 g. of sodium salt of 3-chloro-2-hydroxypropanesulfonic acid and 1,600 g. of water are then added and the mixture is again heated to reflux for 2 hours. The resulting solution contains about 25% of acylated and sulfoalkylated polyethyleneimine and is utilized as electroplating zinc brightener, according to this invention.

Instead of polyethyleneimine, one may use the N-hydroxyethyl polyethyleneimine of molecular weight comprised between 400 and 5,000. A polypropyleneimine of molecular weight between 500 to 5,000 may also be used as starting polymer.

Valuable brighteners may be obtained in the same way, by using other acid anhydrides, namely: propionic anhydride, hexanoic anhydride, benzoic anhydride, homophthalic anhydride, naphthalic anhydride (1,8), 1,2-dihydrobenzoic anhydride, and 3,4-dihydronaphthalic anhydride.

EXAMPLE 5

To 189.3 g. (1 mole) of tetraethylenepentamine and 200 g. water are added dropwise 92.5 g. (1 mole) of epichlorohydrin, maintaining the reaction temperature at 30–35° C., by cooling. The mixture is then heated to 60° C. and 67 g. (0.5 mole) of sulfopropionic anhydride are added and the temperature is raised and maintained for 3 hours at the reflux temperature under agitation. The final product is diluted with water to obtain a 25% solution of zinc electroplating brightener.

In order to obtain bright zinc electrodeposits, the acylated polymers described in this invention are added in an alkaline zinc electroplating bath, in concentration of 0.1 to 50 grams per liter of bath, preferably of 3 to 10 grams per liter of bath.

The zinc electroplating baths, object of this invention, consist of an aqueous solution of an alkaline zincate, like the sodium or potassium zincate, in presence of an excess of alkaline hydroxyde (e.g. sodium or potassium hydroxide), and may comprise, eventually, an alkaline cyanide, although the principal object of this invention is to provide cyanide free alkaline zinc electroplating baths.

The concentration of zinc in these baths is usually comprised between 5 and 20 grams per liter of zinc ions, and the concentration of the alkaline hydroxide between 70 and 200 g/l.

These baths may also comprise certain organic complexing agents, often used in zinc electroplating, such as sodium gluconate, sodium citrate, sodium tartrate, or amino acids, but these compounds are not indispensable to reach the objects of this invention.

Apart from the basic constituents mentioned above, the electroplating baths of this invention comprise, in solution, an effective amount of one or several acylated nitrogen-containing polymers in conformity with those described above; the total concentration of these polymers is of 0.1 to 50.0 grams per liter of bath.

According to another object of this invention, the acylated polymers described above are associated, in the zinc plating bath, with one or several secondary brighteners or additives, with the purpose to enhance the brilliance or the bright plating range of the zinc electrodeposits obtained from these baths.

As secondary additives, one may utilize aromatic aldehydes, phenol aldehydes, quaternary pyridinium derivatives, quaternary derivatives of nicotinic acid, the reaction products of aromatic aldehydes with amines and, also, some natural or synthetic water soluble polymers known in the art, such as polyvinyl alcohol, various qualities of glues, gums and gelatines, the homopolymers of acrylamide, the homopolymers of acrylic acid. The concentrations range of these secondary additives, in the zinc plating bath, is from 0.05 to 10.0 grams per liter of bath.

The Table 1 gives nonlimiting examples of secondary additives which may be advantageously associated with the acylated polymers of this invention.

Particularly favorable, according to this invention, is the association of the acylated nitrogen-containing polymers described above with quaternary compounds of formula:

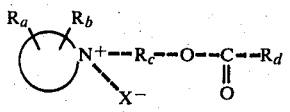

(III)

wherein:

$R_a$ and $R_b$ are each, independently one of another, hydrogen, halogen, lower alkyl (1 to 4 carbon atoms), alkoxy, hydroxy, carboxy, carboxy-alkyl, carboxy aryl, sulfoxy, amino or amido;

$R_c$ is an alkylene group which may be unsubstituted or substituted with one or several substituents selected from: lower alkyl, lower halo-alkyl, halogen or hydroxy;

$R_d$ is alkyl, alkenyl, phenyl, phenoxy, benzyl, naphthyl, naphthoxy, alkylphenyl, furyl or thienyl and may be unsubstituted or substituted with one or several substituents selected from: hydroxy, carboxy, alkyl, alkoxy, sulfoxy, or halogen;

X is an anion compatible with the bath, such as halogen, hydroxy or sulfate, or X is nothing when the polarity of the nitrogen atom $N_+$ is neutralized by another constituent of the molecule; and

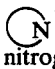

represents a heterocyclic compound with tertiary nitrogen such as pyridine, quinoline or isoquinoline.

The concentration of these quaternary compounds in the zinc plating bath is favorably comprised between 0.05 and 3.0 g/l.

The association, in the alkaline zinc electroplating bath, of the quaternary compounds of formula (III) with the acylated, nitrogen-containing polymers described in this invention, makes it possible to obtain zinc electrodeposits very bright and uniform and having no tendency to form blisters. In Table 1 are several examples of compounds of formula (III).

TABLE 1

SECONDARY ADDITIVES

| | Compound | Optimal concentration in the zinc plating bath g/l |
|---|---|---|
| (1) | Benzoic aldehyde | 0.1–1.5 |
| (2) | o-, m- and p-methylbenzoic aldehydes | 0.1–1.5 |
| (3) | o- and p-methoxybenzaldehydes | 0.1–1.5 |
| (4) | o-, m- and p-hydroxybenzaldehydes | 0.1–1.5 |
| (5) | Vanillin | 0.1–0.5 |
| (6) | Heliotropin | 0.1–1.5 |
| (7) | Veratraldehyde | 0.1–0.8 |
| (8) | o- and p-ethoxybenzaldehydes | 0.1–1.0 |
| (9) | 2-Styrylpyridine | 0.05–1.0 |
| (10) | 2-Benzylaminopyridine | 0.05–1.2 |
| (11) | Benzylidene-2'.2'-dipyridylamine | 0.05–0.8 |
| (12) | 1-Benzyl-pyridinium-3-carboxylate | 0.05–1.5 |
| (13) | 1-Benzyl-5-carboxy-pyridinium-3-carboxylate | 0.05–1.5 |
| (14) | Sodium polyacrylate | 0.5–10.0 |
| | Quaternary compounds of formula (III): | |
| (15) | 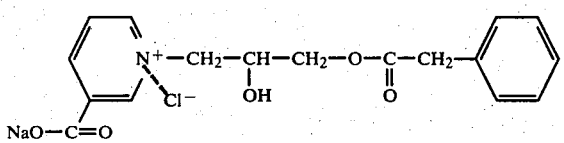 | 0.1–1.5 |

TABLE 1-continued

SECONDARY ADDITIVES

| Compound | Optimal concentration in the zinc plating bath g/l |
|---|---|
| (16) 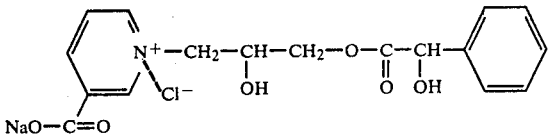 | 0.1–1.5 |
| (17) 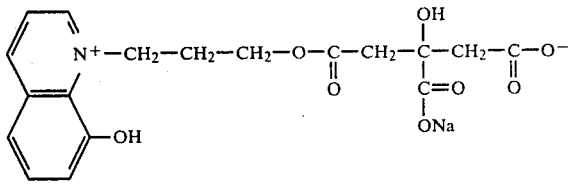 | 0.1–0.9 |
| (18) 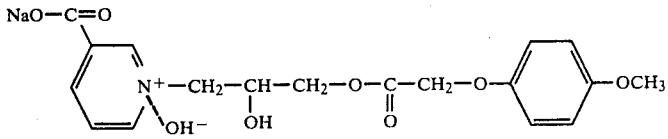 | 0.05–1.0 |
| (19) 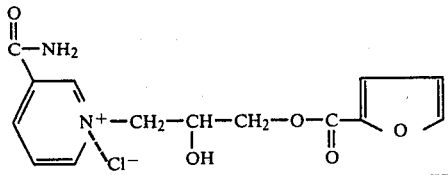 | 0.05–2.0 |

The following examples show zinc electroplating baths in conformity with the invention:

EXAMPLE 6

A stock of basic solution of alkaline zinc plating bath of the following composition is prepared:

| | |
|---|---|
| Sodium hydroxide | 110 g/l |
| Zinc oxide | 12.5 g/l |

The sodium hydroxide and the zinc oxide, of pure quality, are dissolved in water to form an alkaline solution of sodium zincate, comprising about 10 g/l of zinc metal.

In this bath, there are added the additives as per the following examples, to obtain bright zinc electrodeposits:

EXAMPLE 7

In the bath of Example 6 there is added:

| | |
|---|---|
| Acylated polyethyleneimine solution obtained as per Example 1 | 10 ml/l |

Under a cathodic current density of 0.1 to 3.0 A/dm$^2$ and a bath temperature of 20 to 35° C., there are obtained, on a metallic object made cathode, uniform and fine grained zinc electrodeposits, without blisters and with a medium brilliance.

EXAMPLE 8

In the bath of Example 6 there is added:

| | |
|---|---|
| Acylated polymer solution obtained as per Example 1 | 10 ml/l |
| Heliotropin | 0.1 g/l |
| Furfural | 0.1 g/l |

The aldehydes are employed either as a 10% alcoholic solution, or as an aqueous solution of their bisulfite adduct.

Bright, uniform and ductile zinc electrodeposits are obtained under 0.1 to 4.0 A/dm$^2$ cathodic current density and at a bath temperature of 20 to 35° C.

EXAMPLE 9

In the bath of Example 6, there is added:

| | |
|---|---|
| Acylated polymer solution obtained as per Example 2 | 15 ml/l |
| Compound No. 16 of Table 1 | 0.3 g/l |

Bright and uniform zinc electrodeposits are obtained at the cathode, under current densities from 0.1 to 6.0 A/dm$^2$.

EXAMPLE 10

An alkaline zinc electroplating bath of the following composition is prepared:

| | |
|---|---|
| Sodium hydroxide | 100 g/l |
| Zinc oxide | 10 g/l |
| Sodium carbonate | 30 g/l |
| Acylated polymer solution obtained as per Example 4 | 20 ml/l |
| Veratraldehyde bisulfite adduct | 0.3 g/l |
| Compound No. 15 of Table 1 | 0.5 g/l |

There is obtained, on objects made cathodes in this bath, very bright and uniform zinc deposits, under a cathodic current density of 0.1 to 7.0 A/dm$^2$ and at a bath temperature between 17 and 35° C. The electroplated parts are chromated according to known techniques and may be heated up to 200° C. without the formation of any blisters.

The present invention is not limited to the above examples, numerous other variants being realizable by the man of the art, by applying the formulae and methods described in this specification.

What I claim is:

1. An aqueous alkaline electroplating bath for bright zinc electrodeposition, comprising:

(a) an aqueous solution of an alkaline zincate, and (b) a sufficient amount, effective to provide bright, ductile and uniform zinc electrodeposits, of a polymer having recurrent units of alkyleneamine in which at least one nitrogen atom is bound to an acyl group of formula:

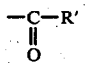

wherein R′ represents an alkyl, alkenyl, phenyl, alkylphenyl, naphthyl, pyridyl, furyl or thienyl radical, which radical may be unsubstituted or substituted with one or several substituents selected from: hydroxy, alkyl, carboxy, sulfoxy or halogen.

2. The bath as defined in claim 1 wherein said polymer is present in solution in quantities of 0.1 to 50.0 grams per liter of bath.

3. The bath as defined in claim 1 wherein said polymer is an acylated polyalkyleneimine.

4. The bath as defined in claim 1 wherein said polymer is an acylated polyethyleneimine.

5. The bath as defined in claim 4 wherein said polymer is obtained by the acylation of a polyethyleneimine of molecular weight between 150 and 60,000.

6. The bath as defined in claim 1 wherein said polymer is an acylated polyethyleneimine having at least one of its polymer chain alkylene groups substituted with an alkyl group, said alkyl group being a member selected from the group consisting of:

unsubstituted alkyls and substituted alkyls, said substituted alkyls being substituted by one or more identical or different members selected from the group consisting of: hydroxy, carboxy, carboxy-ester, halogen, primary amino, secondary amino, and tertiary amino.

7. The bath as defined in claim 6 wherein said polymer is obtained by the acylation of a substituted polyethyleneimine of molecular weight from 200 to 60,000.

8. The bath as defined in claim 1 wherein said polymer is obtained by at least partial acylation of a polyethyleneimine and by further alkylating at least one nitrogen atom belonging to said polymer with an alkyl group, which alkyl group is unsubstituted or substituted by one or several identical or different members selected from the group consisting of hydroxy, carboxy, carboxy-ester and sulfoxy.

9. The bath as defined in claim 1 wherein said polymer is the product of the acylation of the reaction product of ammonia, an aliphatic amine, or an alkylenepolyamine with an epihalohydrin or a dihalohydrin.

10. The bath as defined in claim 1 wherein said polymer is the product of the acylation of a polyethyleneimine with an acylating agent selected from the group consisting of: propionic acid, homophthalic acid, benzoyl chloride, lauroyl chloride, butyric anhydride, phthalic anhydride, benzoic anhydride, and 1,8naphthalic anhydride.

11. The bath as defined in claim 10 wherein said polymer is further alkylated with an alkylating agent selected from the group consisting of: methyl chloride, ethylenechlorhydrin, methyl sulfate, ethyl sulfate, chloroethanesulfonic acid, 3chloro-2-hydroxypropanesulfonic acid.

12. The bath as defined in claim 1 and containing additionally a secondary brightener in concentration of 0.05 to 10.0 g/l.

13. The bath as defined in claim 12 wherein said secondary brightener is an aromatic aldehyde.

14. The bath as defined in claim 12 wherein said secondary brightener is 1-benzylpyridinium-3-carboxylate.

15. The bath as defined in claim 12 wherein said secondary brightener is the compound:

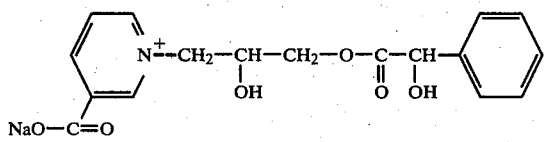

16. A method of bright zinc electroplating in which an object is made cathode in an electroplating bath as defined in claim 1.

* * * * *